United States Patent [19]

Bronchart

[11] Patent Number: 4,970,426

[45] Date of Patent: Nov. 13, 1990

[54] SPARK PLUG FOR INTERNAL COMBUSTION ENGINE

[75] Inventor: Jacques A. Bronchart, Ohain, Belgium

[73] Assignee: Champion Spark Plug Europe S.A., Binche, Belgium

[21] Appl. No.: 245,778

[22] Filed: Sep. 16, 1988

[30] Foreign Application Priority Data

Sep. 17, 1987 [GB] United Kingdom ..... 8721890

[51] Int. Cl.[5] ..... H01T 13/32

[52] U.S. Cl. ..... 313/141; 313/142

[58] Field of Search ..... 313/142, 141

[56] References Cited

U.S. PATENT DOCUMENTS

| | | | |
|---|---|---|---|
| 1,515,866 | 11/1924 | Marten . | |
| 1,762,989 | 6/1930 | Hurley . | |
| 2,254,169 | 8/1941 | Dillon | 313/142 X |
| 2,296,033 | 9/1942 | Heller . | |
| 4,023,058 | 5/1977 | Lara et al. | 313/139 |
| 4,288,714 | 9/1981 | Yamada et al. | 313/142 |
| 4,329,615 | 5/1982 | Tanaka et al. | 313/141 |
| 4,540,910 | 9/1985 | Kondo et al. | 313/11.5 |

FOREIGN PATENT DOCUMENTS

| | | | |
|---|---|---|---|
| 2189545 | 10/1987 | United Kingdom | 313/141 |

*Primary Examiner*—Palmer C. DeMeo

*Attorney, Agent, or Firm*—MacMillan, Sobanski & Todd

[57] ABSTRACT

The spark plug according to the invention comprises a shell (1), a central electrode (3) surrounded by an insulator (2) and a ground electrode (4) which, according to the invention, has a cross section (**4*a*) such that the surface of the ground electrode (4) which is located nearest to the bottom end of the central electrode (3) is larger than the surface of the ground electrode (4) which is located farthest away from said bottom end of the central electrode (3). The ground electrode (4) may be provided with a copper core and its surface nearest to the bottom end of the central electrode (3) may be provided with a precious metal insert. The surface of the ground electrode which is farthest away from the bottom end of the central electrode (3**) may be reduced to a line and the lateral surfaces of the ground electrode may be curved surfaces.

8 Claims, 2 Drawing Sheets

SPARK PLUG FOR INTERNAL COMBUSTION ENGINE

BACKGROUND OF THE INVENTION

The present invention relates to a spark plug comprising a shell, a central electrode, an insulator surrounding the central electrode, said central electrode having a top end portion and a bottom end portion, and further comprising a ground electrode of which one of its end portions is secured to said shell and of which the other of its end portions extends in front of the bottom end portion of the central electrode, wherein the ground electrode is longitudinally defined by an inner surface, an outer surface and two lateral surfaces.

Spark plugs of the thus defined type are well known in prior art and are for example disclosed in U.S. Pat. No. 4,427,915, in U.S. Pat. No. 4,540,912 and in U.S. Pat. No. 4,568,855. The spark plugs of prior art, and in particular the spark plugs disclosed in the three mentioned U.S. patents, are generally provided with a ground electrode which has a rectangular cross section. Independently of the configuration of the central electrode the rectangular cross section of the ground electrode does not garantee a maximal resistance to the erosion of the ground electrode. In other words, in giving a different configuration to the cross section of the ground electrode it is possible, as will be explained hereunder, to improve the resistance to erosion of the ground electrode, i.e. to prolong its life period.

SUMMARY OF THE INVENTION

The object of the invention is thus to provide a spark plug having a prolonged life period with respect to prior art spark plugs of the same type.

The spark plug according to the invention is substantially characterized by the fact that at least in the area of the bottom end portion of the central electrode the inner surface of the ground electrode is larger than the outer surface of said electrode.

Other features of the spark plug according to the invention are for example that:

in the area of the bottom end portion of the central electrode the inner surface of the ground electrode is a flat surface, in the area of the bottom end portion of the central electrode the lateral surfaces of the ground electrode are flat surfaces, in the area of the bottom end portion of the central electrode the lateral surfaces of the ground electrode are curved surfaces.

The life period of the thus described spark plug can still be improved by providing a ground electrode consisting of an outer layer and of an inner core made of different materials, the outer layer being for example made of a nickel alloy and the inner core being for example made of copper. Such a bi-metal ground electrode has a longer life period because it has a better resistance to corrosion. Indeed the copper core evacuates more rapidly the heat existing in the free end portion of the ground electrode and the resistance to corrosion increases when the temperature of the ground electrode decreases.

Further features of the spark plug according to the invention will be better understood when reading the following portions of the description in conjunction with the appended drawings.

DESCRIPTION OF THE PREFERRED EMBODIMENTS

Figure 1:
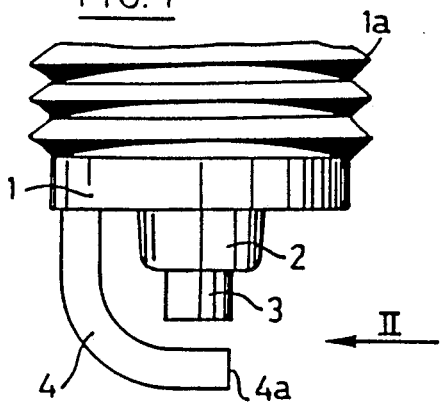
FIG. 1 is a partial elevational view of a spark plug according to a first embodiment of the invention.
Figure 2:
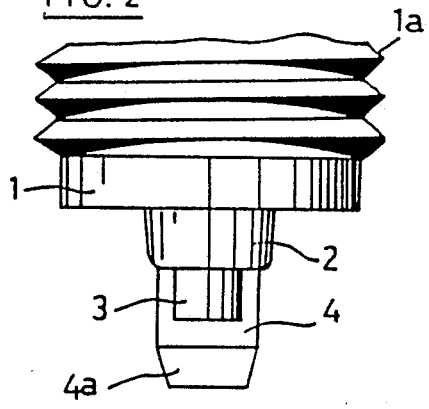
FIG. 2 is a view, along arrow II, of the spark plug of FIG. 1.
Figure 3:
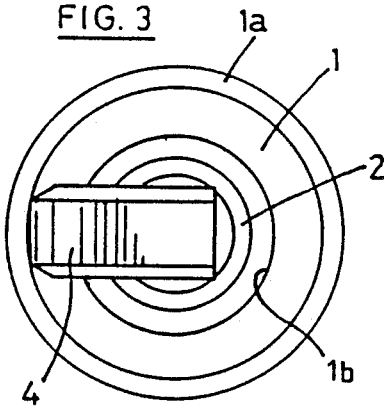
FIG. 3 is a bottom view of the spark plug of FIG. 1.
Figure 4:
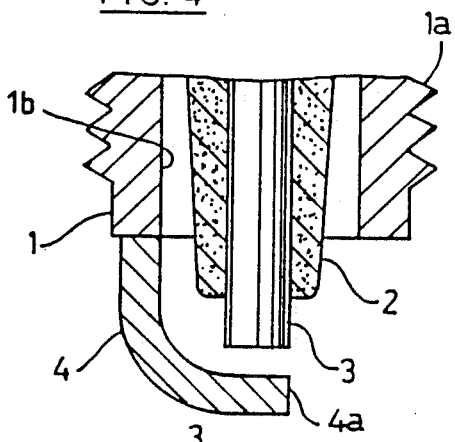
FIG. 4 is an axial, sectional view of the spark plug of FIG. 1.

As can be seen in FIGS. 1 through 4 the spark plug according to the first embodiment of the invention comprises: a shell 1 provided with a thread 1*a*, a central electrode 3 surrounded by an insulator 2 and a ground electrode 4 of which one of its end portions is secured to the shell 1 and of which the other of its end portions extends in front of the bottom end portion of the central electrode 3. In the area of the bottom end portion of the central electrode 3 the ground electrode 4 has a trapezoidal cross section 4*a* (FIG. 2).

Figure 5:
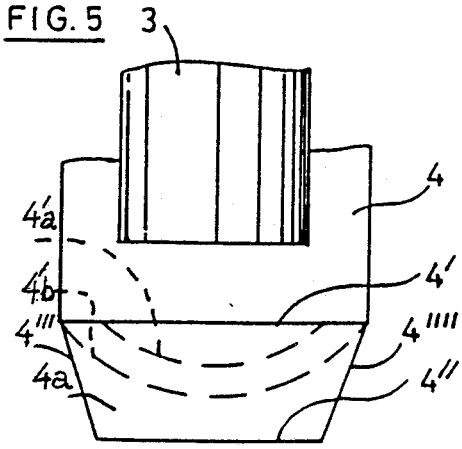
FIG. 5 is an enlarged elevational view of a portion of the spark plug of FIG. 2.

The enlarged view of FIG. 5 shows that the trapezoidal cross section of the ground electrode 4 is defined by the inner surface 4', by the outer surface 4'' and by the two lateral surfaces 4''', 4'''' of said ground electrode.

As said above the ground electrode 4 is subject to erosion, i.e. said electrode is eroded by the sparks which bridge the gap between the free end portion of the ground electrode 4 and the central electrode 3. Said erosion affects only the inner surface 4' of the ground electrode 4, at least when the spark plug is relatively new, and it is evident that the importance of the erosion (as to the thickness of the eroded layer) depends on the size of the inner surface 4' which extends in front of the central electrode 3. The larger said surface 4' is, the less the erosion penatrates into the ground electrode. It is therefore advantageous to have an inner surface 4' as large as possible.

Figure 5A:
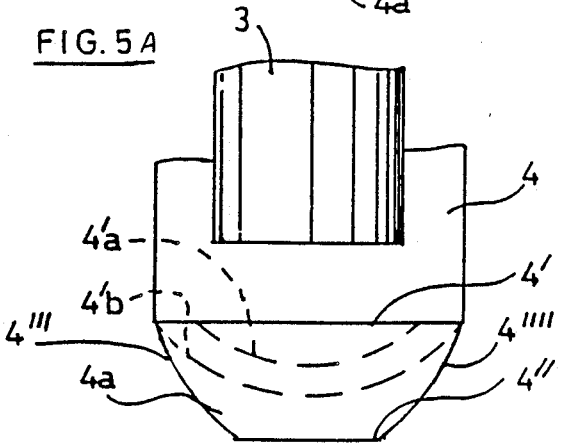
FIG. 5A is an enlarged elevational view of a modified portion of the spark plug of FIG. 2.

In the spark plug according to the first embodiment of the invention this knowledge has been put into practice by adopting a ground electrode 4 which has a trapezoidal cross section such as shown for example in FIG. 5. In fact the cross section of the ground electrode is not necessarily trapezoidal. Indeed it only matters that the inner surface 4' of the ground electrode 4 is larger than the outer surface 4'' of said electrode. In other words the laterel walls 4''', 4'''' of the ground electrode could for example be curved surfaces as shown in FIG. 5A.

At the point where the ground electrode 4 is secured to the shell 1 (FIG. 4) said electrode should not project beyond the inner and/or the outer cylindrical surface of said shell. Moreover, because of the phenomenon known to the man of the art as "cold fouling" the diameter of the inner cylindrical surface 1*b* of the shell 1 should be maximized. This means, since the outer cylindrical surface of the shell 1 is determined by the thread in the engine, that the thickness of the shell 1 must be minimized.

In view of the above constraints ground electrodes having a rectangular cross section (see prior art) do not permit to have the largest possible inner surface without projecting beyond the inner and/or the outer cylindrical surface of the shell 1. The largest possible inner surface of the ground electrode is obtained by a ground electrode wherein the inner surface is larger than the outer surface, i.e. by a ground electrode such as disclosed in the present specification.

"Cold fouling" is a phenomenon wherein, when the engine and the spark plugs are cold, the sparks have a tendency not only to bridge the gap between the central electrode 3 and the ground electrode 4, but also to bridge the gap between the central electrode 3 and the shell 1. This phenomenon should be avoided because of its negative consequences on the normal functioning of the spark plug.

FIG. 5 shows how the ground electrode according to the invention is eroded with time. The ground electrode is first eroded directly underneath the central electrode 3 and after a certain period of time the inner surface 4' of the ground electrode has taken the form shown by the interrupted line 4'*a*. In conventional spark plugs said line 4'*a* substantially corresponds to the whole inner surface of the ground electrode, i.e. in conventional spark plugs the lateral surfaces of said electrode would be eroded after said first period of time.

However, in the spark plug according to the invention the lateral surfaces 4''', 4'''' of the ground electrode 4 are only eroded after a second period of time, i.e. when the inner surface 4' has taken the form shown by the interrupted line 4'*b*. Moreover, since the total volume of material taken away from the ground electrode of similar spark plugs working under similar conditions can be considered as being substantially the same, the thickness (distance between the inner surface 4' and the outer surface 4'') of the ground electrode according to the invention will diminish less quickly than the thickness of the ground electrode of a conventional spark plug. In other words, the spark plug according to the invention has a longer life period than similar conventional spark plugs.

Figure 6:
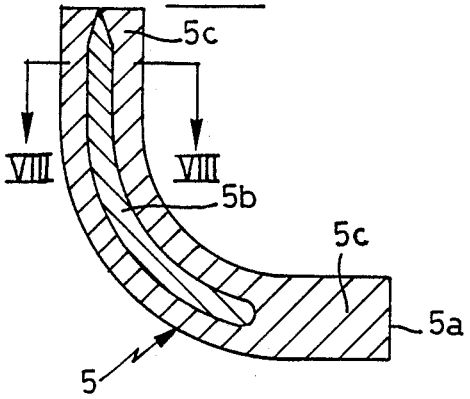
FIG. 6 is an enlarged sectional view of a portion of a spark plug showing a first variant of the first embodiment of the invention.
Figure 8:
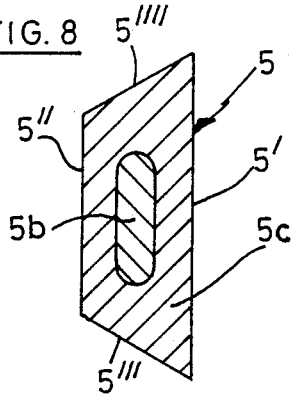
FIG. 8 is, at a larger scale, a sectional view along line VIII—VIII of FIG. 6.

FIGS. 6 and 8 show a first variant of the ground electrode according to the first embodiment of the invention. In this variant the ground electrode 5 is made of two different materials, the outer layer 5*c* being for example made of a nickel alloy and the inner core 5*b* being for example made of copper.

As already explained above the object of the copper-core 5*b* is to evacuate more rapidly the heat existing in the free end portion of the grond electrode 5 and thus to increase the life period of said electrode by a better resistance to corrosion.

Figure 7:
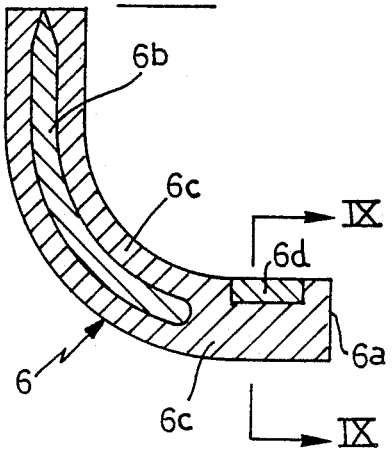
FIG. 7 is an enlarged sectional view of a portion of a spark plug showing a second variant of the first embodiment of the invention.
Figure 9:
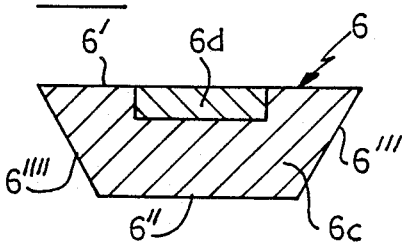
FIG. 9 is, at a larger scale, a sectional view along line IX—IX of FIG. 7.

The ground electrode 6 of FIGS. 7 and 9 embodies a second variant of the ground electrode according to the first embodiment of the invention. In this variant the ground electrode is not only made of an outer layer 6*c* (e.g. nickel alloy) and of an inner core 6*b* (e.g. copper), but in the area of the bottom end portion of the central electrode the inner surface 6' is further provided with an insert 6*d* made of a precious metal.

The object of the precious metal insert 6*d* is to still prolong the life period of the ground electrode. Indeed most precious metals have a better resistance to erosion than the nickel alloys generally used for manufacturing the ground electrodes of spark plugs.

As can be seen in FIGS. 8 and 9 the ground electrodes 5, 6 of the two variants of the first embodiment of the invention both have a trapezoidal cross section 5*a*, 6*a* respectively defined by the surfaces 5', 5'', 5''', 5'''' and 6', 6'', 6''', 6''''.

Figure 10:
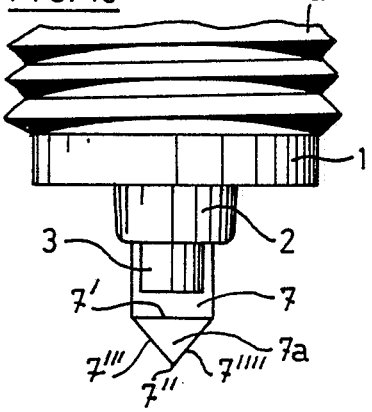
FIG. 10 is a partial elevational view of a spark plug according to a second embodiment of the invention.
Figure 11:
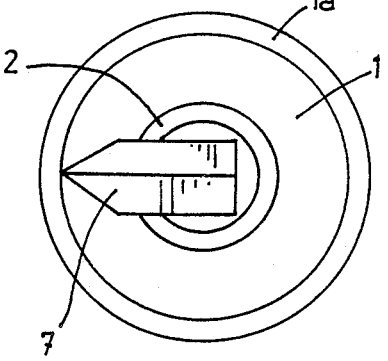
FIG. 11 is a bottom view of the spark plug of FIG. 10.

FIGS. 10 and 11 show the second embodiment of the invention, said embodiment comprising: a shell 1 provided with a thread 1*a*, a central electrode 3 surrounded by an insulator 2 and a ground elecrode 7. In the area of the bottom end portion of the central electrode 3 the ground electrode 7 has a triangular cross section 7*a*.

The triangular cross section 7*a* (inner surface 7' and lateral surfaces 7''', 7'''') of this ground electrode is in fact only a limiting case of the trapezoidal cross section 4*a*, 5*a*, 6*a* of the first embodiment of the invention wherein the outer surface 4'', 5'', 6'' has been reduced to a line (7'') and therefore the above explanations on erosion and on corrosion (FIGS. 5 through 9) also apply to this second embodiment of the invention. In particular the triangular shaped ground electrode 7 can be provided with a copper core and/or with a precious metal insert. It is further to be noted that the lateral surfaces 7''', 7'''' can be either flat or curved surfaces.

I claim:

1. A spark plug comprising a shell, a central electrode, an insulator surrounding said central electrode, said central electrode having a bottom end portion, and further comprising a ground electrode having two end portions with one of its end portions secured to said shell and the other of its end portions extending in front of said bottom end portion of said central electrode, wherein in at least the area of said bottom end portion of said central electrode, said ground electrode is longitudinally defined by an inner surface nearest said bottom end portion of said central electrode, an outer surface and two lateral surfaces interconnecting said inner and outer surfaces, characterized in that, in at least in the area of said bottom end portion of said central electrode, said inner surface of said ground electrode is larger than said outer surface of said ground electrode and said lateral surfaces of said ground electrode are flat surfaces.

2. A spark plug according to claim 1, characterized in that in the area of said bottom end portion of said central electrode, said inner surface of said ground electrode is a flat surface.

3. A spark plug according to claim 1, characterized in that in the area of said bottom end portion of said central electrode, said outer surface of said ground electrode is reduced to a line.

4. A spark plug comprising a shell, a central electrode, an insulator surrounding said central electrode, said central electrode having a bottom end portion, and further comprising a ground electrode having two end portions with one of its end portions secured to said shell and the other of its end portions extending in front of said bottom end portion of said central elecrode, wherein in at least the area of said bottom end portion of said central electrode said ground electrode is longitudinally defined by an inner surface, an outer surface and two lateral surfaces interconnecting said inner and outer surfaces, characterized in that in at least in the area of said bottom end portion of said central electrode, said inner surface of said ground electrode is larger than said outer surface of said ground electrode and said inner and outer surfaces of said ground electrode are flat surfaces.

5. A spark plug according to claim 4 characterized in that in the area of said bottom end portion of the central electrode, said lateral surfaces of said ground electrode are flat surfaces.

6. A spark plug according to claim 4 characterized in that in the area of said bottom end portion of said central electrode, said lateral surfaces of said ground electrode are curved surfaces.

7. A spark plug according to claim 4 characterized in that said ground electrode consists of an outer layer and of an inner core made of different materials.

8. A spark plug according to claim 4 characterized in that in the area of said bottom end portion of said central electrode, said inner surface of said ground electrode is provided with an insert made of a precious metal.

* * * * *